US008068750B2

(12) United States Patent
Kadowaki

(10) Patent No.: US 8,068,750 B2
(45) Date of Patent: Nov. 29, 2011

(54) IMAGE FORMING APPARATUS WITH WASTE TONER COLLECTING DEVICE

(75) Inventor: Hideaki Kadowaki, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 345 days.

(21) Appl. No.: 12/413,685

(22) Filed: Mar. 30, 2009

(65) Prior Publication Data

US 2009/0252526 A1 Oct. 8, 2009

(30) Foreign Application Priority Data

Apr. 2, 2008 (JP) ..... 2008-095939

(51) Int. Cl.
*G03G 21/10* (2006.01)
*G03G 21/12* (2006.01)
*G03G 15/08* (2006.01)

(52) U.S. Cl. ..... 399/35; 399/99; 399/358; 399/360

(58) Field of Classification Search ..... 399/35
See application file for complete search history.

(56) References Cited

U.S. PATENT DOCUMENTS

| | | | | |
|---|---|---|---|---|
| 4,982,231 | A * | 1/1991 | Matsuuchi | 399/35 |
| 2003/0072577 | A1 * | 4/2003 | Higgins et al. | 399/35 |
| 2005/0036810 | A1 * | 2/2005 | Murakami et al. | 399/360 |
| 2006/0285899 | A1 * | 12/2006 | Dianetti | 399/360 |
| 2007/0292179 | A1 * | 12/2007 | Kudo | 399/358 |
| 2009/0022532 | A1 * | 1/2009 | Fukunaga et al. | 399/360 |

FOREIGN PATENT DOCUMENTS

| | | | |
|---|---|---|---|
| JP | 63-174088 | A | 7/1988 |
| JP | 8-160822 | A | 6/1996 |
| JP | 9-222795 | | 8/1997 |
| JP | 10-39601 | A | 2/1998 |
| JP | 2003-029516 | A | 1/2003 |
| JP | 2005-173451 | A | 6/2005 |
| JP | 2005173451 | A * | 6/2005 |
| JP | 2005-338397 | A | 12/2005 |
| JP | 2007-108416 | A | 4/2007 |

* cited by examiner

*Primary Examiner* — David Gray
*Assistant Examiner* — David Bolduc
(74) *Attorney, Agent, or Firm* — Nixon & Vanderhye P.C.

(57) ABSTRACT

An image forming apparatus includes a cleaning portion for collecting waste toner from various locations within the image forming apparatus. Waste toner collected by the cleaning portion is routed to a waste toner collecting container. The waste toner collecting container includes a waste toner receptacle for storing the waste toner, a waste toner collector for leading the waste toner collected by the cleaning portion into the waste toner receptacle, and a flexible joint that couples the waste toner collector and the waste toner receptacle. The waste toner collecting container is removably mounted to the image forming apparatus. The flexible joint has the function of extending and contracting itself to enable the waste toner receptacle to move relative to the waste toner collector. A detector may be provided to detect an amount of waste toner collected in the container.

13 Claims, 11 Drawing Sheets

IMAGE FORMING APPARATUS WITH WASTE TONER COLLECTING DEVICE

This Nonprovisional application claims priority under 35 U.S.C. §119(a) on Patent Application No. 2008-95939 filed in Japan on 2 Apr. 2008, the entire contents of which are hereby incorporated by reference.

BACKGROUND OF THE TECHNOLOGY (1) Field of the Technology

The present technology relates to an image forming apparatus, and in particular relates to an image forming apparatus including a waste toner collecting container for collecting waste toner.

(2) Description of the Prior Art

In the conventional image forming apparatuses based on electrophotography such as facsimile machines, printers and the like, image forming is performed by electrifying a rotationally driven photoreceptor drum by a charger, illuminating the photoreceptor drum with light in accordance with image information to form an electrostatic latent image, and applying toner to this electrostatic latent image by a developing unit to form a toner image. In some configurations called an intermediate transfer system, this toner image is temporarily transferred to an intermediate transfer medium such as a transfer belt or the like, then the toner image is transferred from the intermediate transfer medium to a recording medium such as sheet material, paper or the like, to produce a printout of the image. In other configurations, the toner image on the photoreceptor drum is directly transferred to a recording medium to produce a printout of the image.

In the photoreceptor drum (toner image bearer) on which toner images are formed in the thus configured image forming apparatus, at the transfer stage all the developed image information (toner image) on the photoreceptor drum cannot be transferred to the paper or the intermediate transfer medium. The transfer efficiency is usually, and roughly, estimated to be 85 to 95%, though this depends on the transfer mechanism used.

If a next printing operation is started without the toner that has not transferred to the paper, and remains on the photoreceptor drum, being cleaned, degradation of the print quality in the next printing operation will occur. To deal with this problem, the photoreceptor drum, after the transfer stage, and the intermediate transfer belt that receives a toner image from the photoreceptor drum and transfers it to the paper, are cleaned by associated cleaning units, so as to remove the leftover toner from them (cleaning stage). The toner collected at the cleaning stage is stored as waste toner into a waste toner box (waste toner collecting container).

The conventional waste toner box is removably mounted to the main body. When the waste toner box becomes full of waste toner, the box is unmounted from the main body, and mounted again after the waste toner is disposed or the box is replaced by a new empty waste toner box.

As a method for detecting the full waste toner box, there has been a conventionally known method in which, the waste toner collecting container is adapted to be retained by an elastic member such as a spring or the like, the downward shift of the waste toner collecting container due to the weight of the waste toner therein is detected by a sensor (see patent document 1: Japanese Patent Application Laid-open 2005-173451).

However, the above method suffers the problem that waste toner, as it falls into the waste toner collecting container, scatters because a gap arises between the waste toner discharge port for discharging waste toner, provided on the main body side of the image forming apparatus, and the waste toner receiving port for leading waste toner into the receptacle when the waste toner collecting container has moved down.

There is also another problem that, especially in a compact image forming apparatus, it is impossible to secure the space for storing a large quantity of waste toner because the vacant space in the apparatus has been limited so as to achieve its miniaturization. To deal with this, as a conventional technology, a waste toner collecting container which is formed to be extensible and contractible so that the capacity of the waste toner receptacle can be changed, has been disclosed (see patent document 2: Japanese Patent Application Laid-open H10-39601).

However, the toner collecting container configuration of patent document 2 needs to have an inner receptacle for storing waste toner and an exterior receptacle that is formed in a telescopic manner of multiple parts for covering the inner receptacle. As a result, there are problems that the receptacle configuration is complicated and that the quantity of waste toner collected in the receptacle is indistinct.

SUMMARY OF THE TECHNOLOGY

The present technology has been devised in view of the above conventional problems, it is therefore an object of the technology to provide an image forming apparatus in which the space for accommodating the waste toner collecting container in the apparatus can be efficiently used by using the space for permitting the waste toner collecting container to move, as the storage space for waste toner and in which the quantity of toner in the waste toner collecting container can be easily detected.

In order to achieve the above object, the image forming apparatus of the technology is configured as follows:

An image forming apparatus includes: a cleaning portion for collecting waste toner, which is the toner that was supplied to form a toner image on a toner image bearer but has not transferred to the recording medium and remains on the toner image bearer after the transfer stage; a waste toner discharger for discharging the waste toner collected by the cleaning portion; a waste toner collecting container; and a detector, and is characterized in that the waste toner collecting container includes: a waste toner receptacle for storing the waste toner discharged from the waste toner discharger; a waste toner collector for leading the waste toner collected by the cleaning portion into the waste toner receptacle; and a joint for coupling the waste toner collector and the waste toner receptacle, the waste toner collecting container is removably mounted to the image forming apparatus; the joint has the function of extending and contracting itself (in the vertical direction, for example) to enable the waste toner receptacle to shift relative to the waste toner collector; and the detector, when the waste toner receptacle has moved due the weight of the collected waste toner in the waste toner receptacle, detects the waste toner receptacle that has moved.

In the image forming apparatus, it is preferable that a vibrator for vibrating the waste toner receptacle is provided adjacently to the waste toner receptacle.

In the image forming apparatus, it is preferable that the joint is formed of an elastic member.

In the image forming apparatus, it is preferable that a supporting portion for supporting the waste toner receptacle by elastic force is provided.

In the image forming apparatus, it is preferable that the supporting portion is integrally formed with the bottom of the waste toner receptacle.

In the image forming apparatus, it is preferable that the waste toner collector includes a fitting portion that engages the waste toner discharger.

In the image forming apparatus, it is preferable that the waste toner collecting container includes a plurality of waste toner collectors arranged side by side for leading the waste toner collected from a plurality of cleaning portions.

In the image forming apparatus, it is preferable that the detector is prohibited from detecting the waste toner receptacle while the vibrator is vibrating the waste toner receptacle.

In the image forming apparatus, it is preferable that the detector detects the full state of the waste toner collecting container.

In the image forming apparatus, it is preferable that the detector detects the quantity of waste toner collected in the waste toner collecting container at multiple levels.

In the image forming apparatus, it is preferable that the detector is formed of a contact type switch.

In the image forming apparatus, it is preferable that the detector is formed of a reflection type optical sensor.

In the image forming apparatus, it is preferable that the detector is formed of a shading type optical sensor.

According to one aspect of the image forming apparatus, since the joint is made to have the function of extending and contracting itself to enable the waste toner receptacle to shift relative to the waste toner collector while the detector detects the waste toner receptacle that has moved, it is possible to detect the waste toner receptacle that has moved by extension of the joint in accordance with the collected weight in the toner receptacle. As a result, it is possible to simply detect a condition where a predetermined amount of waste toner is collected in the waste toner collecting container or where the receptacle is full of waste toner, for example.

Since the joint has the function of extending and contracting itself to enable the waste toner receptacle to shift relative to the waste toner collector, it is possible to change the capacity of collectable waste toner by the movement of the waste toner receptacle despite that the waste toner collector is fixed to the waste toner discharger.

According to another aspect of the image forming apparatus, since a vibrator for vibrating the waste toner receptacle is arranged adjacently to the waste toner receptacle, it is possible to increase the storable quantity of waste toner by leveling the pile of toner inside the container.

According to another aspect of the image forming apparatus, when the joint is formed of an elastic member, it is possible to simply support the waste toner receptacle without use of any separate member, such as a spring, for supporting the waste toner receptacle.

According to another aspect of the image forming apparatus, since a supporting portion for supporting the waste toner receptacle by elastic force is provided, it is possible to control the distance of extension of the joint in accordance with the retaining force of the supporting portion.

According to another aspect of the image forming apparatus, since the supporting portion is integrally formed with the bottom of the waste toner receptacle, it is possible to attach or detach the supporting portion at the same time when the waste toner collecting container is mounted or unmounted. Accordingly, the mounting and unmounting operation of the waste toner collecting container can be simplified.

According to another aspect of the image forming apparatus, since the waste toner collector is provided with a fitting portion that engages the waste toner discharger, it is possible to prevent the waste toner discharger from dislocating from the waste toner collector, hence waste toner from spilling.

According to another aspect of the image forming apparatus, since the waste toner collecting container is formed with a plurality of waste toner collectors arranged side by side for leading the waste toner collected from a plurality of cleaning portions, it is possible to collect waste toner into a single waste toner receptacle, hence simplify the configuration of the waste toner collecting container.

According to another aspect of the image forming apparatus, since the detector is prohibited from detecting the waste toner receptacle while the vibrator is vibrating the waste toner receptacle, it is possible to prevent mal-detection due to vibration of the vibrator.

According to another aspect of the image forming apparatus, since the detector is adapted to detect the full waste toner collecting container, it is possible for the user to easily know that the waste toner collecting container is full.

According to another aspect of the image forming apparatus, the detector can detect the quantity of waste toner collected in the waste toner collecting container at multiple levels.

According to another aspect of the image forming apparatus, since use of a contact type switch for the detector makes it possible with a simple configuration to positively detect the shift of the waste toner receptacle.

According to another aspect of the image forming apparatus, since a reflection type optical sensor, which does not need any contact actuator, is used as the detector, it is possible with a simple configuration to positively detect the shift of the waste toner receptacle without relying on the condition of an actuator.

Finally, according to another aspect of the image forming apparatus, since a shading type optical sensor, which does not need any contact actuator, is used as the detector, it is possible with a simple configuration to positively detect the shift of the waste toner receptacle without relying on the condition of an actuator.

DESCRIPTION OF THE PREFERRED EMBODIMENTS

The embodiments will hereinafter be described in detail with reference to the accompanying drawings.

Figure 1:
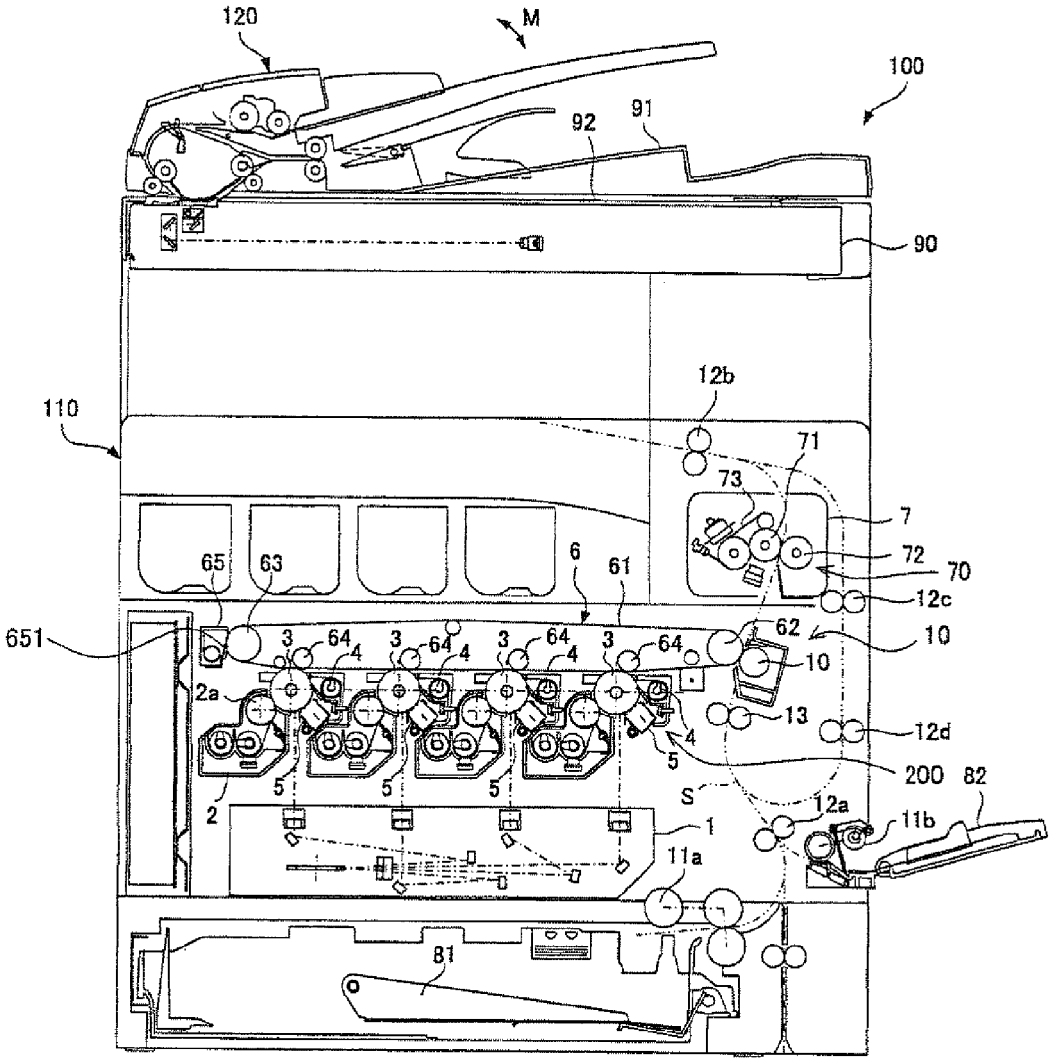
FIG. 1 is an illustrative view showing the overall configuration of an image forming apparatus according to an embodiment.
Figure 2:
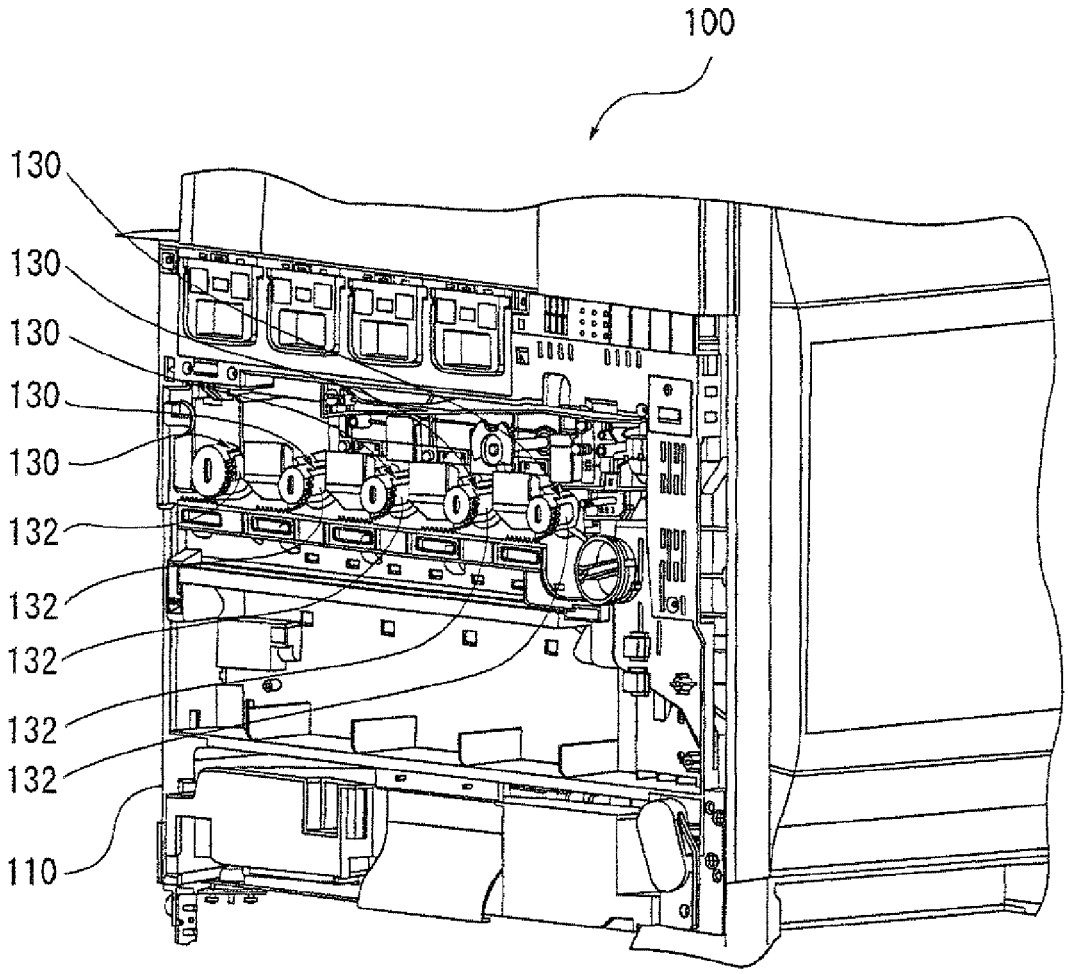
FIG. 2 is an illustrative view showing the interior configuration of the image forming apparatus, viewed from one side.
Figure 3:
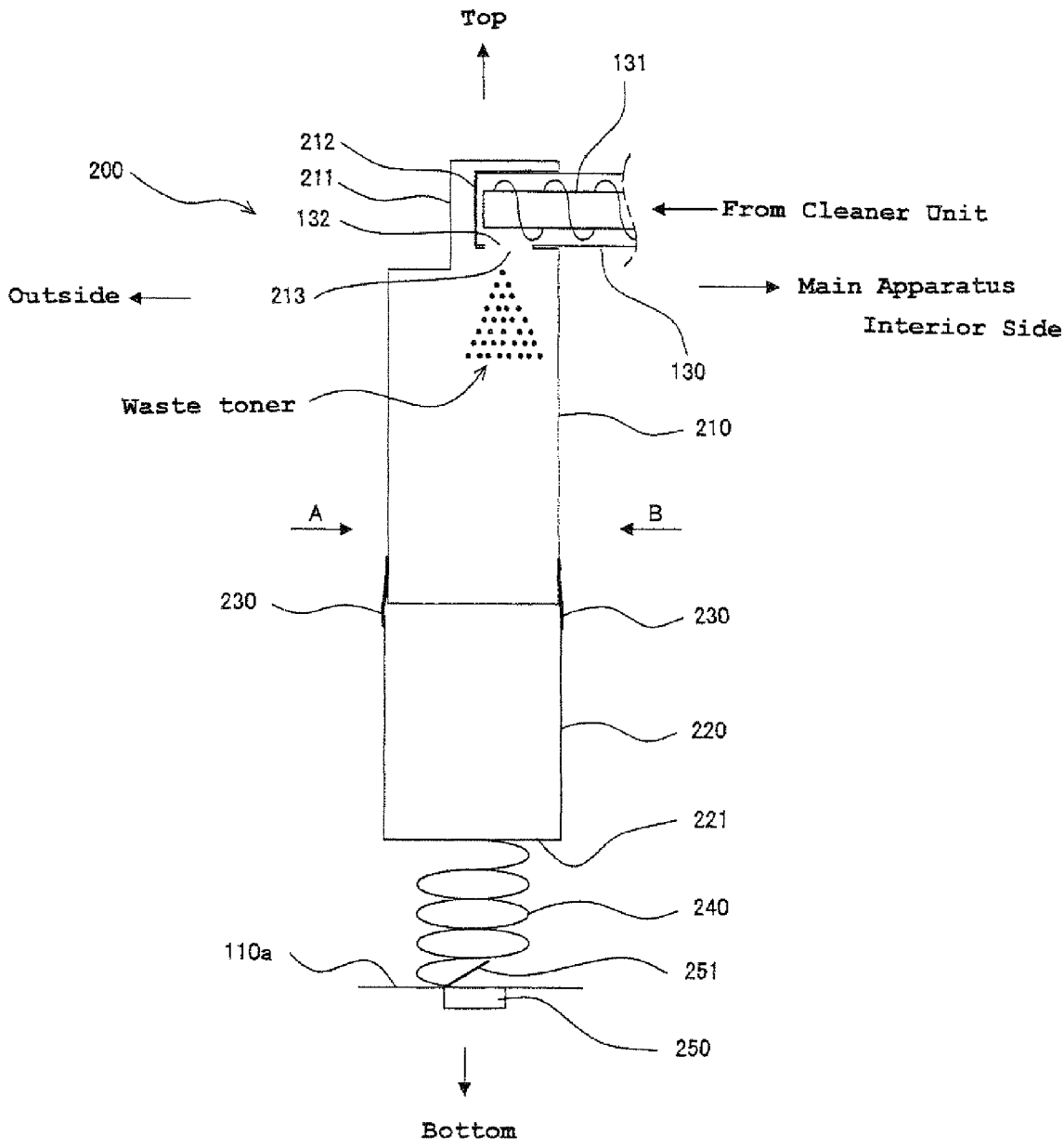
FIG. 3 is an illustrative view showing one configurational example of a waste toner collecting container as a constituent of the image forming apparatus.

FIG. 1 is an illustrative view showing the overall configuration of an image forming apparatus according to an embodiment. FIG. 2 is an illustrative view showing the interior configuration of the image forming apparatus, viewed from one side. FIG. 3 is an illustrative view showing one configurational example of a waste toner collecting container as a constituent of the image forming apparatus.

An image forming apparatus 100 according to the present embodiment includes: as shown in FIGS. 1, 2 and 3, cleaner units (cleaning portion) 4 (FIG. 1) for collecting waste toner, which is the toner that was supplied to form a toner image on a photoreceptor drum (toner image bearer) 3 but has not transferred to the recording medium and remains on the toner image bearer after the transfer stage; waste toner dischargers 130 (FIGS. 2 and 3) for discharging the waste toner collected by cleaner units 4; and a waste toner collecting container 200 (FIGS. 1 and 3).

Waste toner collecting container 200 (FIG. 3) is comprised of a waste toner receptacle 220 for collecting waste toner discharged from waste toner dischargers 130 and a waste toner collector 210 for leading the waste toner collected by cleaner units 4 into waste toner receptacle 220, and is removably mounted in the image forming apparatus.

To begin with, the overall configuration of image forming apparatus 100 according to the present embodiment will be described.

As shown in FIG. 1, image forming apparatus 100 forms a multi-colored or monochrome image on a predetermined sheet (e.g., recording paper) in accordance with image data transmitted from an external device, and is mainly composed of a main apparatus body 110 and an automatic document processor 120.

Main apparatus body 110 includes: an exposure unit 1; developing units 2, photoreceptor drums 3, cleaner units 4, chargers 5, an intermediate transfer belt unit 6, a fusing unit 7, a paper feed cassette 81 and a paper output tray 91.

Arranged on top of main apparatus body 110 is a document table 92 made of a transparent glass plate on which a document is placed. On the top of document table 92, automatic document processor 120 is mounted. Arranged under document table 92 is a document reader (scanner portion) 90 for reading image information of a document.

Automatic document processor 120 automatically feeds documents onto document table 92.

This document processor 120 is constructed so as to be pivotable in the directions of bidirectional arrow M so that a document can be manually placed by opening the top of document table 92.

The image data handled in image forming apparatus 100 is data for color images of four colors, i.e., black (K), cyan (C), magenta (M) and yellow (Y).

Accordingly, four developing units 2, four photoreceptor drums 3, four chargers 5, four cleaner units 4 are provided to produce four electrostatic latent images corresponding to black, cyan, magenta and yellow. That is, four imaging stations are constructed thereby.

Exposure unit 1 corresponds to the image writing device, and is constructed as a laser scanning unit (LSU) having a laser emitter, reflection mirrors, etc. In this exposure unit 1, a polygon mirror for scanning a laser beam, optical elements such as lenses and mirrors for leading the laser beam reflected by the polygon mirror to photoreceptor drums 3 are laid out.

As exposure unit 1, other methods using an array of light emitting elements such as an EL or LED writing head, for example may be used instead.

The thus constructed exposure unit 1 has the function of illuminating each of the electrified photoreceptor drums 3 with light in accordance with the input image data to form an electrostatic latent image corresponding to the image data on the surface of each photoreceptor drum 3.

Developing unit 2 visualizes the electrostatic latent images formed on photoreceptor drums 3 with four color (Y, M, C and K) toners.

Photoreceptor drums 3 each have a cylindrical form and are disposed over exposure unit 1. The surface of each photoreceptor drum 3 is cleaned by cleaner unit 4 and then uniformly electrified by charger 5.

Cleaner unit 4 removes and collects the toner left over on the photoreceptor drum 3 surface after development and image transfer.

Charger 5 is the charging portion for uniformly electrifying the photoreceptor drum 3 surface at a predetermined potential. Other than the corona-discharge type chargers shown in FIG. 1, contact type chargers, i.e., roller type or brush type charger may also be used.

Intermediate transfer belt unit 6 arranged over photoreceptor drums 3 is comprised of an intermediate transfer belt (toner image bearer) 61, an intermediate transfer belt drive roller 62, an intermediate transfer belt driven roller 63, four intermediate transfer rollers 64 corresponding to four YMCK colors and an intermediate transfer belt cleaning unit (cleaning portion) 65.

Intermediate transfer belt drive roller 62, intermediate transfer belt driven roller 63 and intermediate transfer rollers 64 are arranged so as to support and tension intermediate transfer belt 61 and circulatively drive the belt.

Intermediate transfer belt 61 is an endless film of about 100 μm to 150 μm thick and is arranged so as to contact with each photoreceptor drum 3. The toner images of different colors formed on photoreceptor drums 3 are sequentially transferred in layers to intermediate transfer belt 61, forming a color toner image (multi-color toner image) on intermediate transfer belt 61.

Transfer of toner images from photoreceptor drums 3 to intermediate transfer belt 61 are performed by intermediate transfer rollers 64 that are in contact with the rear side of intermediate transfer belt 61.

Each intermediate transfer roller 64 is adapted to apply a transfer bias to intermediate transfer belt 61 to transfer the toner image on photoreceptor drum 3 onto intermediate transfer belt 61. Detailedly, a high-voltage transfer bias (high voltage of a polarity (+) opposite to the polarity (−) of the static charge on the toner) is applied intermediate transfer roller 64 in order to transfer the toner image.

Intermediate transfer roller 64 is a roller that is formed of a base shaft made of metal (e.g., stainless steel) having a diameter of 8 to 10 mm and a conductive elastic material (e.g., EPDM, foamed urethane or the like) coated on the shaft surface. This conductive elastic material enables uniform application of a high voltage to intermediate transfer belt 61. Though the transfer electrodes in the form of rollers are used in the present embodiment, brushes and the like can also be used instead of intermediate transfer rollers 64.

The visualized toner images of colors on different photoreceptor drums 3 are laid over one after another on intermediate transfer belt 61. The thus laminated toner image as the image information is conveyed as intermediate transfer belt 61 moves, and is transferred to the sheet being separately conveyed, by a transfer roller 10*a* that is arranged at the contact position between intermediate transfer belt 61 and the sheet.

In this process, intermediate transfer belt 61 and transfer roller 10*a* are pressed against each other forming a predetermined nip while a voltage for transferring the toner to the paper (a high voltage of a polarity (+) opposite to the polarity (−) of the static charge on the toner) is applied to transfer roller 10*a*.

In order to constantly obtain the predetermined nip between intermediate transfer belt 61 and transfer roller 10*a*, either transfer roller 10*a* or intermediate transfer belt drive roller 62 is formed of a hard material (metal or the like) while the other is formed of a soft material such as an elastic roller or the like (elastic rubber roller, foamed resin roller etc.).

Since, in the aforementioned transfer stage, the toner adhering to intermediate transfer belt 61 as the belt comes in contact with photoreceptor drums 3, or the toner which has not been transferred by transfer roller 10*a* to the sheet and remains on intermediate transfer belt 61, would cause color contamination of toners in the toner image formed at the next operation, the remaining toner is adapted to be removed and collected by intermediate transfer belt cleaning unit 65.

Intermediate transfer belt cleaning unit 65 is arranged at a position, along the path in which intermediate transfer belt 61 is conveyed, downstream of transfer roller 10*a* and upstream of photoreceptor drums 3 with respect to the intermediate transfer belt's direction of movement.

Intermediate transfer belt cleaning unit 65 includes a cleaning blade 651 as a cleaning member that comes in contact with intermediate transfer belt 61 and clean the surface of intermediate transfer belt 61. Intermediate transfer belt 61 is supported from its interior side by intermediate transfer belt driven roller 63, at the portion where this cleaning blade 651 comes into contact with the belt.

Paper feed cassette 81 is a tray for stacking sheets to be used for image forming and is arranged under exposure unit 1 of main apparatus body 110. Also, a manual paper feed cassette 82 that permits sheets to be supplied from without is arranged outside main apparatus body 110.

This manual paper feed cassette 82 can also hold a plurality of sheets to be used for image forming. Arranged in the upper part of main apparatus body 110 is a paper output tray 91 which collects printed sheets facedown.

Main apparatus body 110 further includes a paper feed path S that extends approximately vertically to convey the sheet from paper feed cassette 81 or manual paper feed cassette 82 to paper output tray 91 by way of transfer roller 10*a* and fusing unit 7. Arranged along paper feed path S from paper feed cassette 81 or manual paper feed cassette 82 to paper output tray 91 are pickup rollers 11*a* and 11*b*, a plurality of feed rollers 12*a* to 12*d*, a registration roller 13, transfer roller 10*a*, fusing unit 7 and the like.

Feed rollers 12*a* to 12*d* are small rollers for promoting and supporting conveyance of sheets and are arranged along paper feed path S.

Pickup roller 11*a* is arranged near the end of paper feed cassette 81 so as to pick up one sheet at a time from paper feed cassette 81 and deliver it to paper feed path S.

Pickup roller 11*b* is arranged near the end of manual paper feed cassette 82 so as to pick up one sheet at a time from manual paper feed cassette 82 and deliver it to paper feed path S.

Registration roller 13 temporarily suspends the sheet that is conveyed along paper feed path S. This roller has the function of delivering the sheet toward transfer roller 10*a* at such a timing that the front end of the paper will meet the front end of the image area on intermediate transfer belt 61.

Fusing unit 7 includes a heat roller 71 and a pressing roller 72 as fusing rollers. Heat roller 71 and pressing roller 72 are arranged so as to rotate and convey the sheet while nipping it therebetween.

Further, heat roller 71 is adapted to be set at a predetermined fusing temperature by the controller in accordance with the signal from an unillustrated temperature detector, and has the function of heating and pressing the toner to the sheet in cooperation with pressing roller 72, so as to thermally fix the multi-color toner image transferred on the sheet to the sheet by fusing, mixing and pressing it. The fusing unit further includes an external heating belt 73 for fixing heat roller 71 from without.

Next, the sheet feed path in image forming apparatus 100 will be described.

As shown in FIG. 1, image forming apparatus 100 has paper feed cassette 81 for storing sheets beforehand and manual paper feed cassette 82. In order to deliver sheets from these paper feed cassettes 81 and 82, pickup rollers 11*a* and 11*b* are arranged so as to lead one sheet at a time to paper feed path S.

The sheet delivered from paper feed cassettes 81 or 82 is conveyed by feed rollers 12*a* on paper feed path S to registration roller 13, by which the sheet is released toward transfer roller 10*a* at such a timing that the front end of the sheet meets the front end of the image information on intermediate transfer belt 61 so that the image information is transferred to the sheet. Thereafter, the sheet passes through fusing unit 7, whereby the unfixed toner on the sheet is fused by heat and fixed. Then the sheet is discharged through feed rollers 12*b* onto paper output tray 91.

The paper feed path described above is that of the sheet for a one-sided printing request.

On the other hand, when a duplex printing request is given, the sheet with its one side printed passes through fusing unit 7 and is held at its rear end by feed roller 12*b*, then the feed roller 12*b* rotates in reverse so as to lead the sheet toward feed rollers 12*c* and 12*d*. Thereafter, the sheet passes through registration roller 13 and is printed on its rear side and discharged onto paper output tray 91.

Next, the configuration of waste toner collecting container 200 that characterizes the present embodiment will be described in detail with reference to the drawings.

Figure 4:
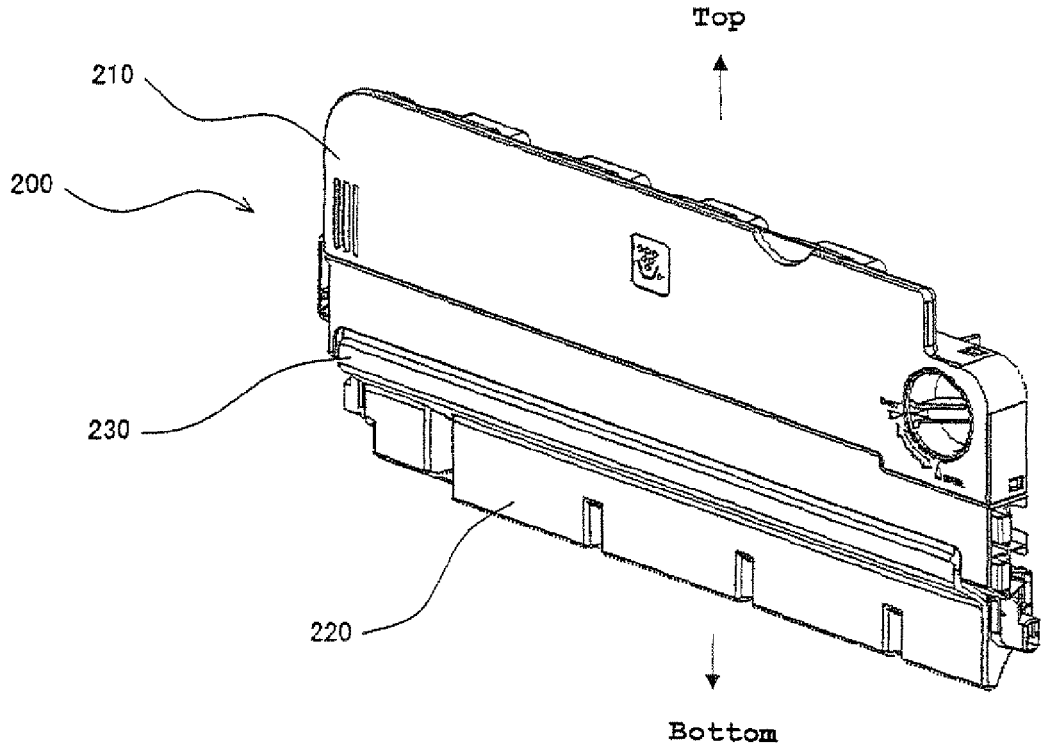
FIG. 4 is a view shown in the direction of arrow A in FIG. 3.
Figure 5:
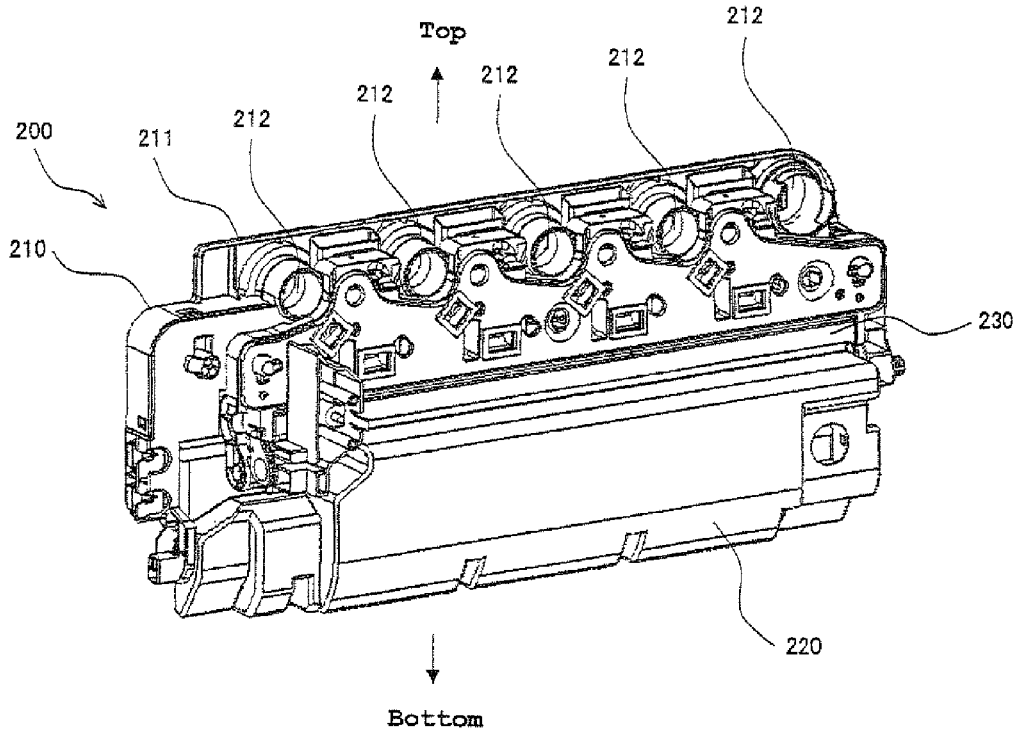
FIG. 5 is a view shown in the direction of arrow B in FIG. 3.
Figure 6:
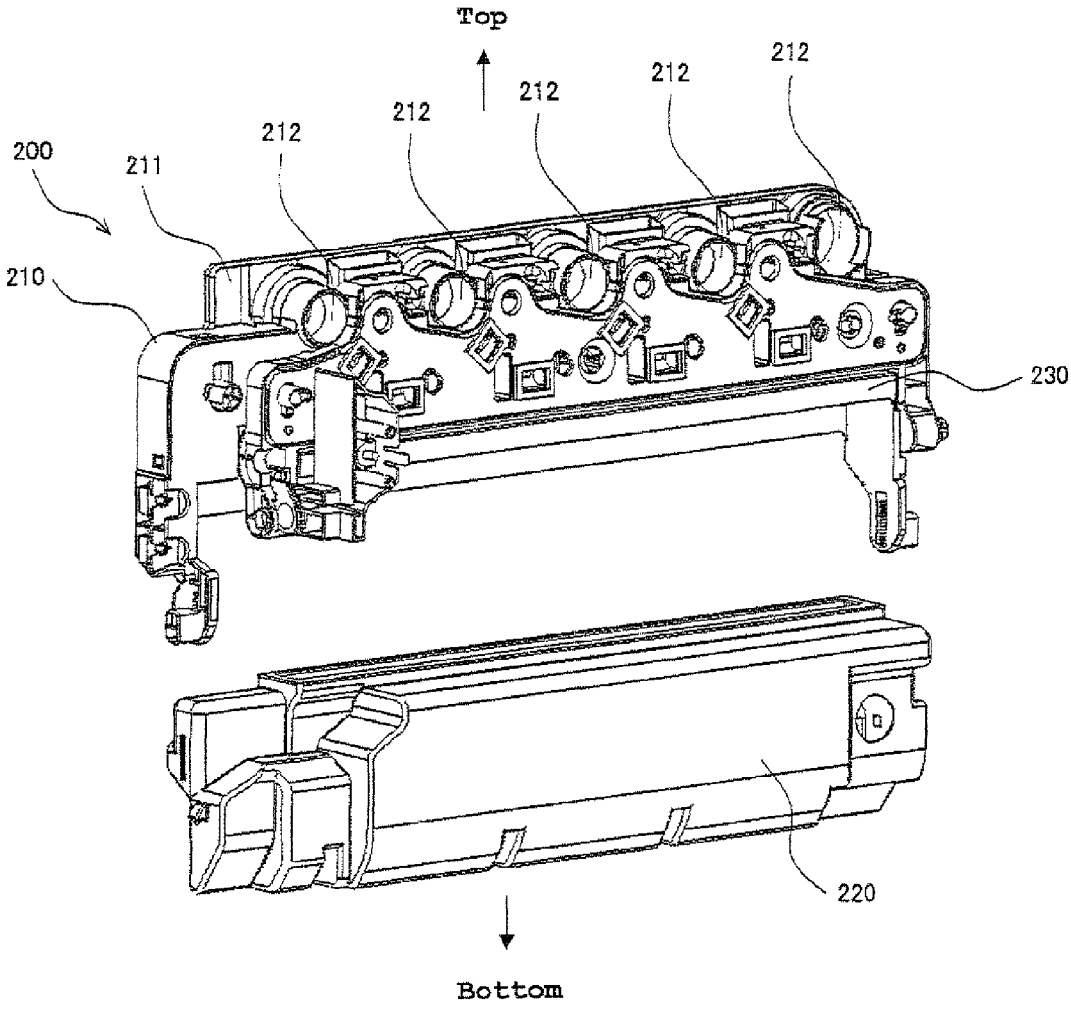
FIG. 6 is an illustrative view showing a state where a waste toner receptacle is separated from the waste toner collecting container.

FIG. 3 is an illustrative view showing one configurational example of a waste toner collecting container as a constituent of the image forming apparatus according to the present embodiment. FIG. 4 is a view shown in the direction of arrow A in FIG. 3. FIG. 5 is a view shown in the direction of arrow B in FIG. 3. FIG. 6 is an illustrative view showing a state where the waste toner receptacle is separated from the waste toner collecting container.

As shown in FIGS. 1 and 3, waste toner collecting container 200 of the present embodiment is comprised of waste toner receptacle 220 for storing waste toner collected from cleaner units 4 for YMCK colors and intermediate transfer belt cleaning unit 65, and a waste toner collector 210 for leading the waste toner collected by each cleaning unit into waste toner receptacle 220.

Waste toner collector 210 and waste toner receptacle 220 are formed separately from each other as shown in FIGS. 3, 4 and 6, and coupled by means of a joint 230 formed of extensible and contractible resin. Specifically, when waste toner collector 210 is set above waste toner receptacle 220, the lower end of waste toner collector 210 and the upper end of waste toner collector 220 are coupled by joint 230.

On the other hand, waste toner dischargers 130 for ejecting the waste toner collected by cleaner units 4 or intermediate transfer belt cleaning unit 65 to the outside of main apparatus body 110 are projected from the main apparatus body 110 side of image forming apparatus 100, as shown in FIGS. 2 and 3.

As shown in FIG. 3, waste toner discharger 130 incorporates a waste toner conveying screw 131 for conveying waste toner collected by cleaner unit 4 or intermediate transfer belt cleaning unit 65, and has a waste toner discharge port 132 for discharging waste toner to the outside, formed to be open at the distal end portion thereof.

In waste toner collector 210, as shown in FIGS. 3 and 5 a fitting portion 211 for receiving a plurality of waste toner dischargers 130 that are connected to cleaner unit 4 or intermediate transfer belt cleaning unit 65 is formed on the side opposing the upper part of the main apparatus body 110 side.

Formed in fitting portion 211 are a plurality of hollowed receiving ports 212 into which respective waste toner dischargers 130 are inserted and attached. In the present embodiment, fitting portion 211 is formed with five receiving ports 212 in a row for receiving five waste toner dischargers 130 that are connected to four cleaner units 4 for Y, M, C and K photoreceptor drums 3 and intermediate transfer belt cleaning unit 65, a shown in FIG. 5.

In receiving port 212, a waste toner conduit 213 for leading the waste toner discharged from waste toner discharge port 132 into waste toner collector 210 is opened at the position opposing waste toner discharge port 132 of waste toner discharger 130 when fitted in place.

Waste toner collector 210 has an open lower end. Waste toner collector 210 is connected to joint 230 with its lower end circumferentially enclosed by one end of joint 230.

Waste toner receptacle 220 has an open upper end. Waste toner receptacle 220 is connected to joint 230 with its upper end circumferentially enclosed by the other end of joint 230. On the other hand, waste toner receptacle 220 has a closed bottom 221 at its lower end. An elastic support (supporting portion) 240 for supporting waste toner receptacle 220 by elastic force is provided on the main apparatus body side under the closed bottom 221.

Joint 230 has a hollow cylindrical configuration in its interior and has an extending and contracting function so as to enable waste toner receptacle 220 to shift vertically with respect to waste toner collector 210. Specifically, joint 230 is constructed such that it takes a normal condition when waste toner receptacle 220 is empty and extends in accordance with the shift of waste toner receptacle 220 when waste toner has been stored in waste toner receptacle 220 and moved downwards.

The extending and contracting function of joint 230 may be realized by its structure by providing a pleated flexible configuration, for instance. Alternatively, the extension and contraction may be realized by the property of the material that forms joint 230.

Elastic support 240 is configured using a coil spring, which is arranged between one surface 110*a* of the main apparatus body 110 side and waste toner receptacle 220 so as to urge waste toner receptacle 220 upwards by elastic force.

Further, a waste toner receptacle detecting sensor (detector) 250 for detecting waste toner receptacle 220 is arranged on the surface 110*a* on the main apparatus body 110 side, at the position opposing bottom 221 of waste toner receptacle 220. Waste toner receptacle detecting sensor 250 is configured using a contact-type switch and has a projected detecting end 251 as a detecting part.

When waste toner receptacle 220 has moved by a predetermined shift so that bottom 221 of waste toner receptacle 220 abuts detecting end 251, waste toner receptacle detecting sensor 250 detects waste toner receptacle 220 (turns ON, for example).

Next, the operation of waste toner collecting container 200 according to the present embodiment will be described with reference to the drawings.

Figure 7:
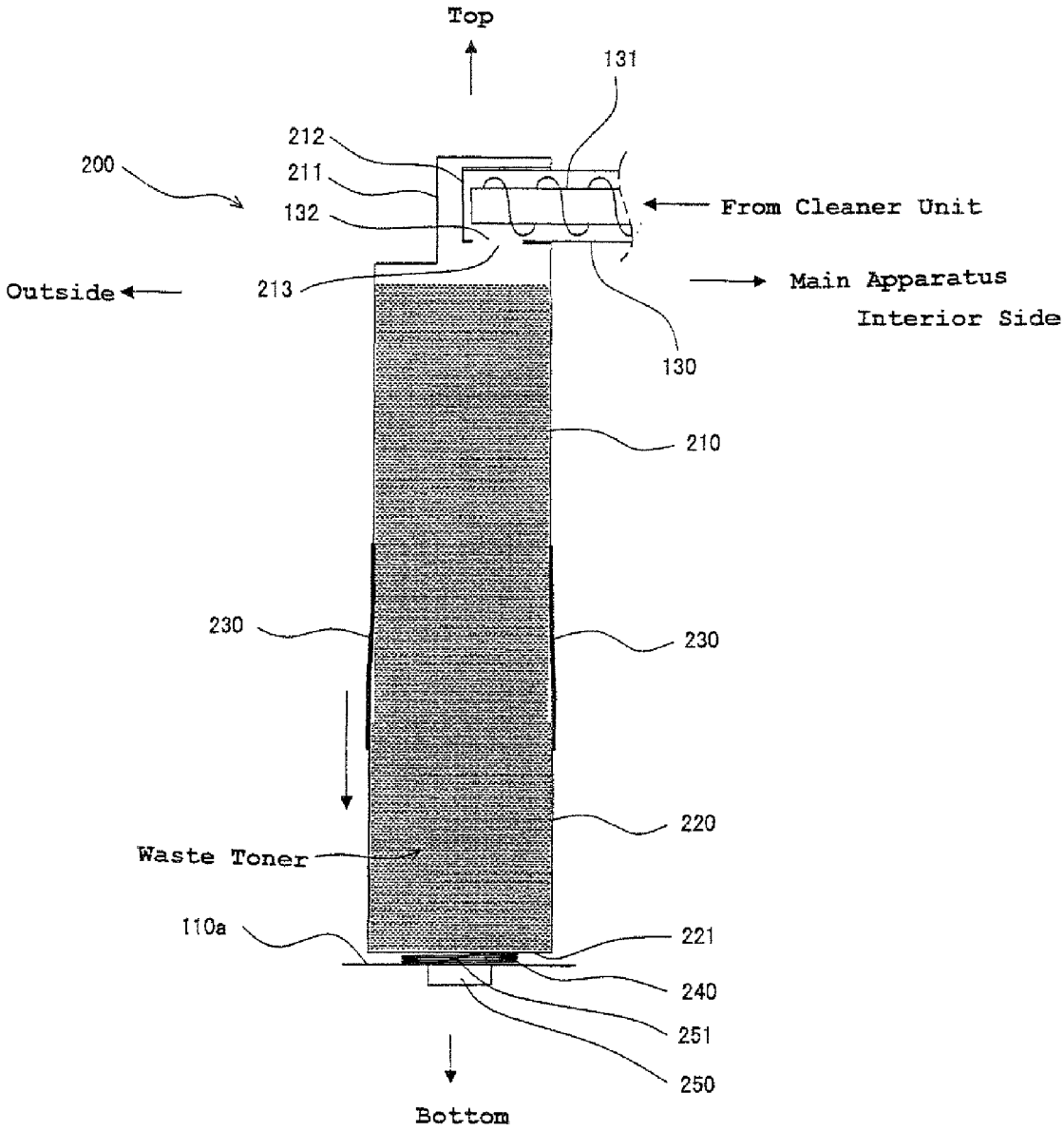
FIG. 7 is an illustrative view showing a state where the waste toner collecting container has been filled with waste toner.

FIG. 7 is an illustrative view showing a state where the waste toner collecting container according to the present embodiment has been filled with waste toner.

When waste toner collecting container 200 of the present embodiment becomes full of collected waste toner (or the collected waste toner exceeds a predetermined amount), the weight of waste toner collected in waste toner collecting container 200 causes waste toner receptacle 220 to move down resisting against the contractile force of joint 230 and the spring force of elastic support 240, as shown in FIG. 7.

At this time, because waste toner collector 210 to which one end of joint 230 is connected is engaged with waste toner discharger 130 hence held by the main apparatus 110 side, joint 230 becomes extended downwards as waste toner receptacle 220 connected to the other end of joint 230 moves downwards.

Then, waste toner receptacle 220 moves downwards and abuts and presses down detecting end 251 of waste toner receptacle detecting sensor 250, waste toner receptacle detecting sensor 250 is turned on so as to output a signal (detection signal).

According to the present embodiment thus described, in waste toner collecting container 200, since waste toner receptacle 220 moves downward as waste toner builds up therein while waste toner collector 210 is retained by the main apparatus body 110 side, joint 230 becomes longer proportionally to the shift of waste toner receptacle 220, hence it is possible to enlarge the storage space of waste toner by the extended part of joint 230. Accordingly, in image forming apparatus 100, it is possible to efficiently use the space for accommodating waste toner collector 200 inclusive of the space for the movement of waste toner receptacle 220.

Further, since a detection signal is output from waste toner receptacle detecting sensor 250 when waste toner receptacle 220 moves down, it is possible to easily detect the waste toner collected in waste toner collecting container 200 exceeding the predetermined amount or the container being full. Accordingly, it is possible to easily detect the quantity of waste toner in waste toner collecting container 200.

That is, the shift of waste toner receptacle 220 in accordance with the quantity of waste toner collected in waste toner collecting container 200 can be determined based on contractile force of joint 230 and the spring force of elastic support (supporting portion) 240, hence the shift can be controlled.

For example, waste toner receptacle detecting sensor 250 is adapted to output a detecting signal when the quantity of waste toner collected in waste toner receptacle 220 reaches the predetermined amount or when waste toner receptacle 220 has moved down by a predetermined distance, and how much amount of waste toner can be still collected after joint 230 has been extended may also be designated.

Further, according to the present embodiment, based on the detection signal output from waste toner receptacle detecting sensor 250, the operation of the apparatus may be temporarily suspended or an indication such as "replace the waste toner collecting container" or the like may be displayed on the display portion of the apparatus, so that it is possible to easily inform the user of the need of replacement of the waste toner collecting container.

Also, according to the present embodiment, since fitting portion 211 is formed in waste toner collector 210 of waste toner collecting container 200 so that waste toner dischargers 130 on the main apparatus body 110 side are fitted to receiving ports 212 of fitting portion 211, it is possible to keep correct engagement with waste toner dischargers 130 regardless of the quantity of waste toner stored in waste toner receptacle 220. Accordingly, it is possible to reliably collect waste toner delivered from waste toner dischargers into waste toner collecting container 200.

Next, variational examples of image forming apparatus 100 of the present embodiment will be described in detail with reference to the drawings. In the following description of variational examples, the overall configuration of the image forming apparatus is supposed to be the same as that shown in the above embodiment, and only the features in the variational examples of waste toner collecting containers will be described while description of the same components is omitted by allotting the same reference numerals.

Variational Example 1

First, variational example 1 will be described in detail with reference to the drawing.

Figure 8:
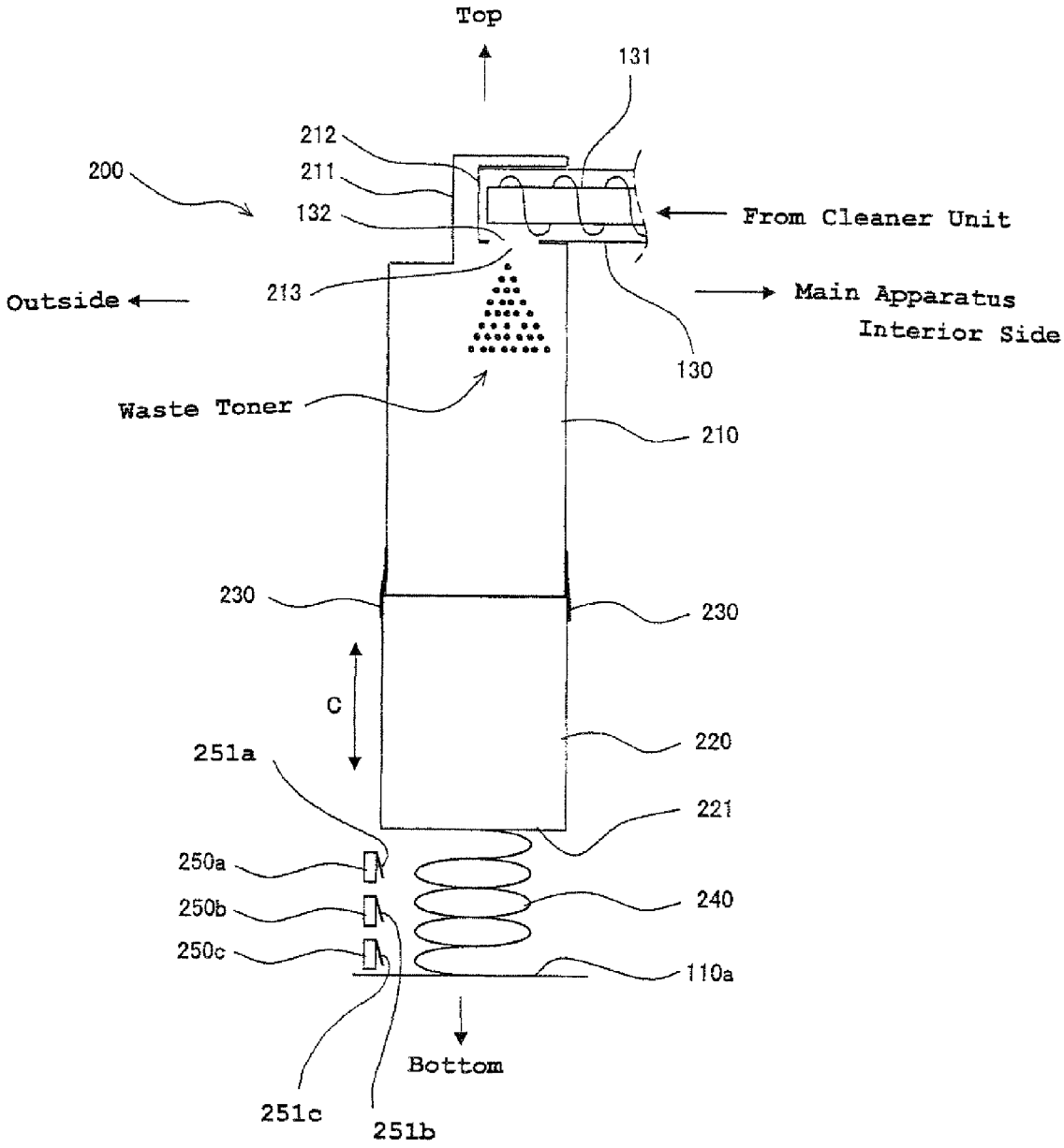
FIG. 8 is an illustrative view showing the configuration of variational example 1 of an image forming apparatus of the present embodiment.

FIG. 8 is an illustrative view showing the configuration of variational example 1 of the image forming apparatus according to the present embodiment.

In the image forming apparatus according to variational example 1, as shown in FIG. 8, waste toner receptacle detecting sensors 250*a*, 250*b* and 250*c* are arranged around the bottom part of waste toner collecting container 200, vertically or along the direction of movement (the direction of arrow C) of waste toner receptacle 220 at intervals of a predetermined distance, so that the sensors will oppose the outer peripheral side of waste toner receptacle 220 when waste toner receptacle 220 has moved down.

Waste toner receptacle detecting sensors 250*a*, 250*b* and 250*c* have the same configurations as that of the aforementioned waste toner receptacle detecting switch 250 using a contact type switch.

Waste toner receptacle detecting sensors 250*a*, 250*b* and 250*c* are set so that detecting ends 251*a*, 251*b* and 251*c* are out of contact with waste toner receptacle 220 in the normal state, hence waste toner receptacle detecting sensors 250*a*, 250*b* and 250*c* are in the non-detection (e.g., OFF) condition. When waste toner receptacle 220 moves as a predetermined amount of waste toner builds up in waste toner collecting container 200, waste toner receptacle 220 moves down with increase of the collected amount of waste toner and touches detecting ends 251*a*, 251*b* and 251*c*, from one to the next. That is, waste toner receptacle detecting sensors 250*a*, 250*b* and 250*c* are arranged so as to be turned on, from one to the next.

This arrangement of multiple waste toner receptacle detecting sensors 250*a*, 250*b* and 250*c* along the outer peripheral side of waste toner receptacle 220 makes it possible to detect the downward shift of waste toner receptacle 220 as waste toner is collected into waste toner collecting container 200. As a result, it is possible with a simple configuration to detect the amount of waste toner collected in waste toner collecting container 200 in a stepwise manner.

Though in this variational example 1, three waste toner receptacle sensors are provided, the technology should not be limited to the number of sensors. For example, it is possible to detect the shift of waste toner receptacle 220 more finely by providing a greater number of sensors.

Variational Example 2

Next, variational example 2 will be described in detail with reference to the drawing.

Figure 9:
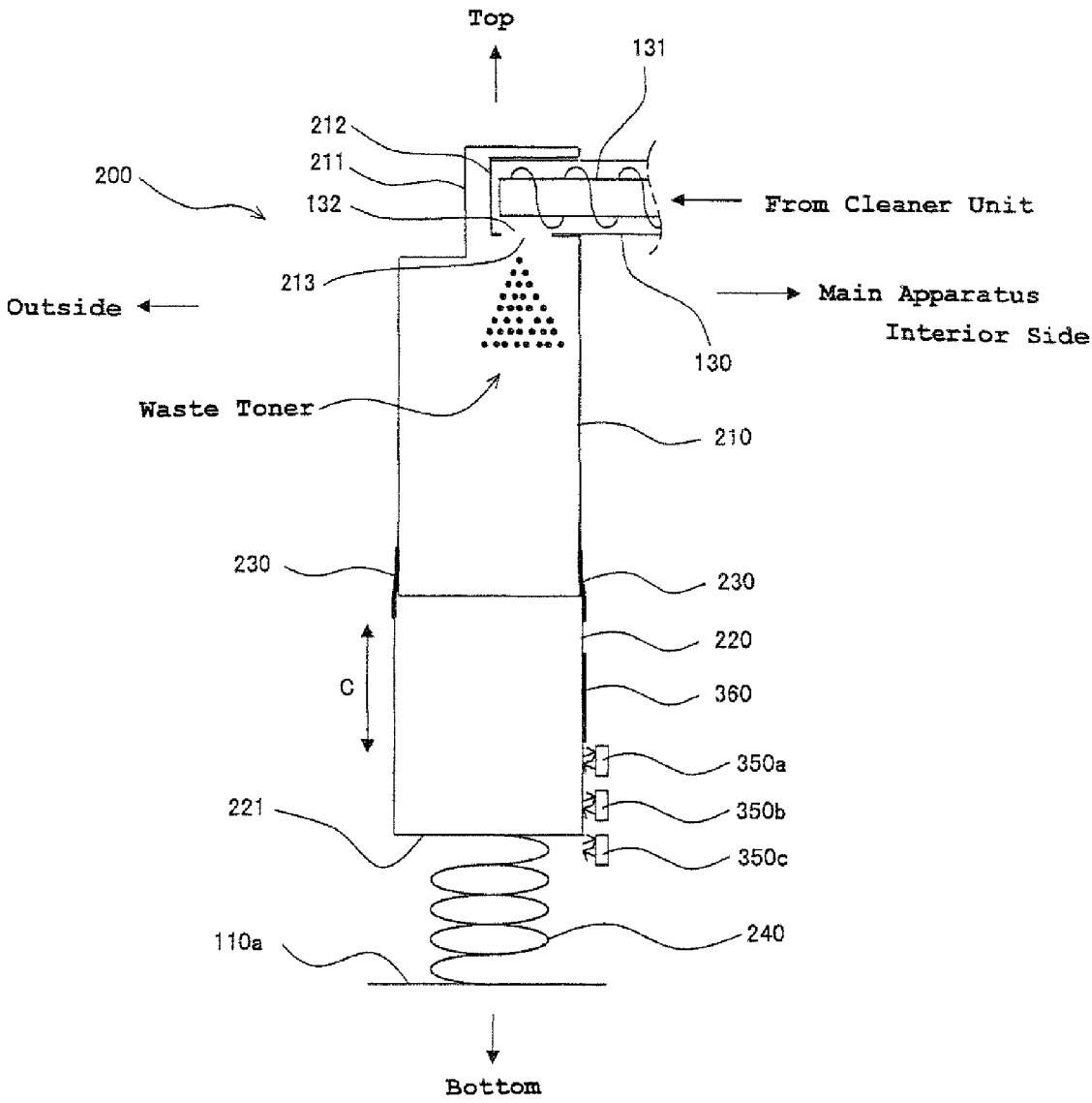
FIG. 9 is an illustrative view showing the configuration of variational example 2 of an image forming apparatus of the present embodiment.

FIG. 9 is an illustrative view showing the configuration of variational example 2 of the image forming apparatus according to the present embodiment.

In the image forming apparatus according to variational example 2, as shown in FIG. 9, waste toner receptacle detecting sensors 350*a*, 350*b* and 350*c* are arranged around the bottom part of waste toner collecting container 200, vertically or along the direction of movement (the direction of arrow C) of waste toner receptacle 220 at intervals of a predetermined distance, so that the sensors will oppose the outer peripheral side of waste toner receptacle 220 when waste toner receptacle 220 has moved down.

In this example, a white sheet 360 is applied on the outer peripheral side of waste toner receptacle 220 in the area where it opposes waste toner receptacle detecting sensors 350*a*, 350*b* and 350*c* when the waste toner receptacle 220 has moved down. Though, in this variational example 2, white sheet 360 is applied on the outer peripheral side of waste toner receptacle 220, any configuration may be used as long as it can reflect light.

Each of waste toner receptacle detecting sensors 350*a*, 350*b* and 350*c* is a reflection-type optical sensor, which produces a detection signal when receiving reflected light from the white sheet.

Waste toner receptacle detecting sensors 350*a*, 350*b* and 350*c* are arranged so as not to oppose white sheet 360 of waste toner receptacle 220 in the normal state and arranged so that, when waste toner receptacle 220 moves as a predetermined amount of waste toner builds up in waste toner collecting container 200, the waste toner receptacle detecting sensors 350*a*, 350*b* and 350*c*, from one sensor to the next, will oppose white sheet 360 and receive reflected light from white sheet 360 with increase of the collected amount of waste toner.

This arrangement of multiple waste toner receptacle detecting sensors 350*a*, 350*b* and 350*c* so as to oppose white sheet 360 on the outer peripheral side of waste toner receptacle 220 makes it possible to detect the downward shift of waste toner receptacle 220 as waste toner is collected into waste toner collecting container 200. As a result, it is possible with a simple configuration to detect the amount of waste toner collected in waste toner collecting container 200 in a stepwise manner.

Further, according to variational example 2, since the shift of waste toner receptacle 220 is detected in a non-contact manner by waste toner receptacle detecting sensors 350*a*, 350*b* and 350*c*, the sensors do not need to have a contact actuator like a contact type switch. Hence it is possible with a simple configuration to positively detect the shift of waste toner receptacle 220 without relying on the condition of an actuator.

Variational Example 3

Next, variational example 3 will be described in detail with reference to the drawing.

Figure 10:
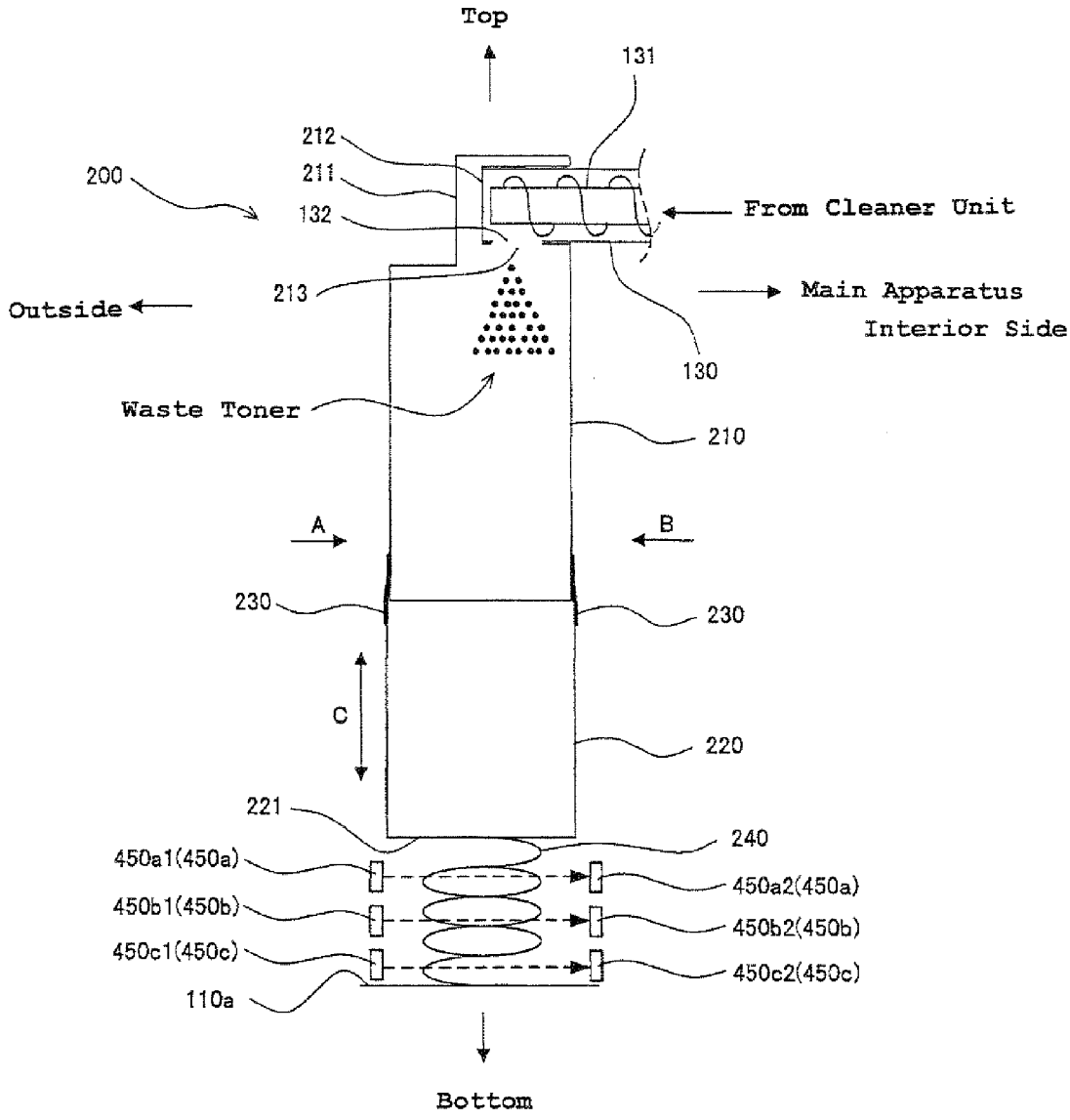
FIG. 10 is an illustrative view showing the configuration of variational example 3 of an image forming apparatus of the present embodiment.

FIG. 10 is an illustrative view showing the configuration of variational example 3 of the image forming apparatus according to the present embodiment.

In the image forming apparatus according to variational example 3, as shown in FIG. 10, waste toner receptacle detecting sensors 450*a*, 450*b* and 450*c* are arranged around the bottom part of waste toner collecting container 200, vertically or along the direction of movement (the direction of arrow C) of waste toner receptacle 220 at intervals of a predetermined distance, so that the sensors will oppose the outer peripheral side of waste toner receptacle 220 when waste toner receptacle 220 has moved down.

Each of waste toner receptacle detecting sensors 450*a*, 450*b* and 450*c* is a light emitter-transmission type optical sensor of a light emitter 450*a*1, 450*b*1 or 450*c*1 and a light receiver 450*a*2, 450*b*2 or 450*c*2, which produces a detection signal when the light receiver receives light emitted from the light emitter.

Waste toner receptacle detecting sensors 450*a*, 450*b* and 450*c* are arranged so that light emitters 450*a*1, 450*b*1 and 450*c*1 and light receivers 450*a*2, 450*b*2 and 450*c*2 respectively oppose each other, each receiver receiving light from corresponding receiver in the normal state. When waste toner receptacle 220 moves down as a predetermined amount of waste toner builds up in waste toner collecting container 200, the receptacle occupies the space between light emitters 450*a*1, 450*b*1 and 450*c*1 and light receivers 450*a*2, 450*b*2 and 450*c*2, shading the emitted light from light emitters 450*a*1, 450*b*1 and 450*c*1, from one to the next.

That is, in variational example 3, waste toner receptacle detecting sensors 450*a*, 450*b* and 450*c* are adapted to detect waste toner receptacle 220 being located when light is blocked.

This arrangement of multiple waste toner receptacle detecting sensors 450*a*, 450*b* and 450*c* so as to be shaded, from one to the next, by waste toner receptacle 220, makes it possible to detect the downward shift of waste toner receptacle 220 as waste toner is collected into waste toner collecting container 200. Thus, it is possible with a simple configuration to detect the amount of waste toner collected in waste toner collecting container 200 in a stepwise manner.

Further, according to variational example 3, since the shift of waste toner receptacle 220 is detected in a non-contact manner by waste toner receptacle detecting sensors 450*a*, 450*b* and 450*c*, as the same manner for variational example 2, the sensors do not need to have a contact actuator like a contact type switch. Hence it is possible with a simple configuration to positively detect the shift of waste toner receptacle 220 without relying on the condition of an actuator.

Variational Example 4

Next, variational example 4 will be described in detail with reference to the drawing.

Figure 11:
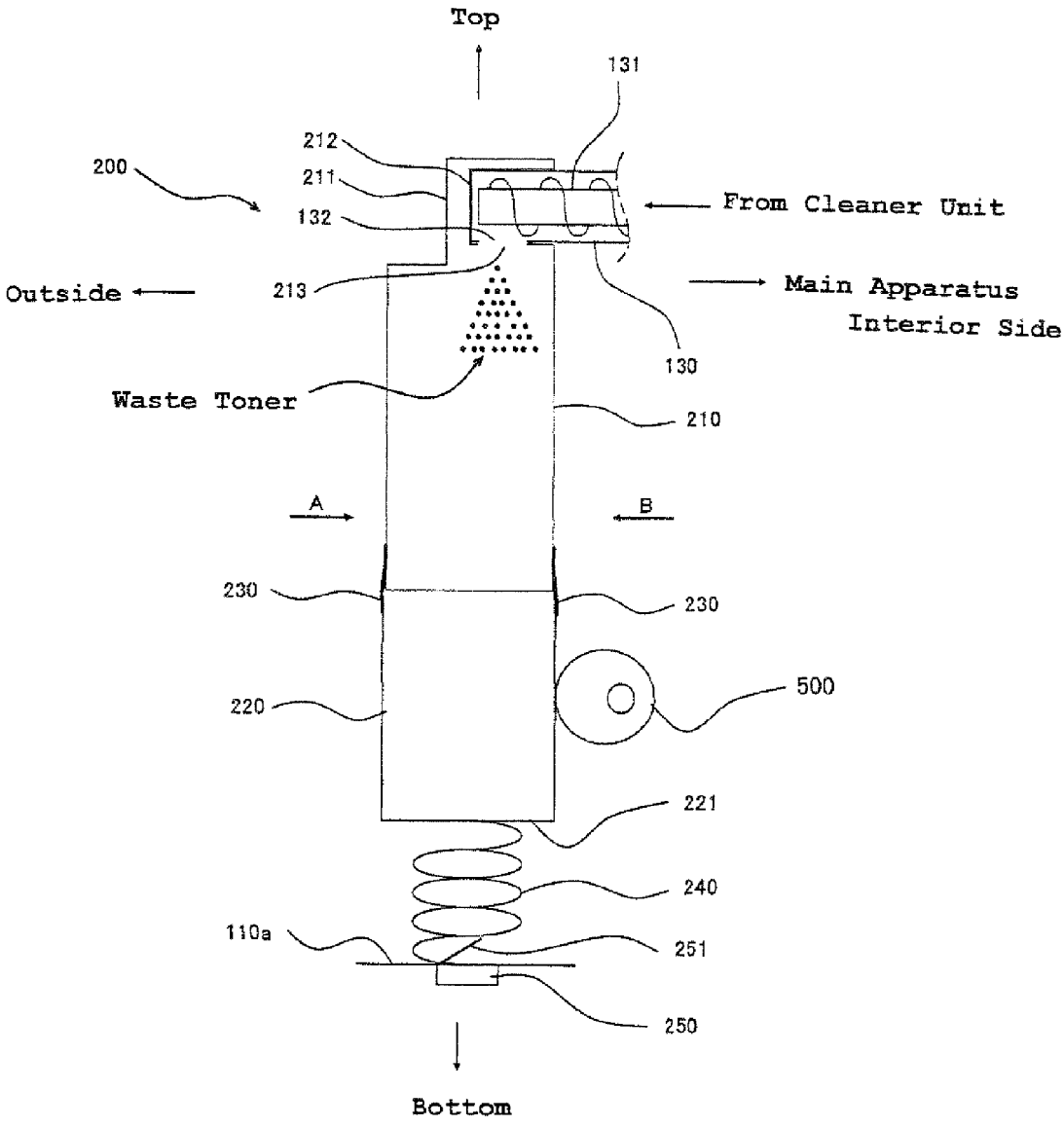
FIG. 11 is an illustrative view showing the configuration of variational example 4 of an image forming apparatus of the present embodiment.

The image forming apparatus according to variational example 4 includes an eccentric cam (vibrator) 500 adjacent to the outer periphery of waste toner receptacle 220 of waste toner collecting container 200, as shown in FIG. 11.

Eccentric cam 500 is arranged so as to vibrate waste toner receptacle 220 when it turns while being in contact with the peripheral side of waste toner receptacle 220.

Waste toner receptacle detecting sensor 250 is controlled to be prohibited from performing detection of waste toner receptacle 220 while eccentric cam 500 is vibrating waste toner receptacle 220.

Eccentric cam 500 is arranged so as to receive drive from a drive motor for the developing unit (not shown) via an unillustrated clutch.

Since this arrangement makes it possible to vibrate toner receptacle 220 by eccentric cam 500 so as to shake and level the pile of toner and compactly settle the waste toner therein beating out empty spaces in the waste toner, it is possible to increase the storable amount of waste toner in waste toner receptacle 220.

Also, since detection of waste toner receptacle 220 is prohibited during eccentric cam 500 vibrating waste toner receptacle 220, it is possible to prevent mal-detection of toner receptor 220 due to vibration of eccentric cam 500.

Since the vibration of eccentric cam 500 transmits to fitting portion 211 through joint 230, vibration to fitting portion 211 is attenuated, so that it is possible to inhibit toner leakage from fitting portion 211 as a result of vibration of eccentric cam 500.

Though, in variational example 4, toner receptacle 220 is vibrated by eccentric cam 500, the vibrator for vibrating toner receptacle 220 is not limited to this configuration.

Further, though variational example 4 demonstrates a case in which eccentric cam 500 is added to the configuration of the embodiment shown in FIG. 3, but eccentric cam 500 may be provided for the configurations shown in FIGS. 8 to 10. Also in these cases, the same effect as above can be obtained.

As described heretofore, according to the embodiment and variational examples described above, waste toner collecting container 200 is formed of waste toner collector 210 and waste toner receptacle 220 which are separated from each other and coupled and integrated by means of extensible joint 230. Therefore, the space for permitting movement of waste toner receptacle 220 when waste toner receptacle 220 moves down due to the weight of collected waste toner while waste toner collector 210 is retained by the main apparatus body 110 side, can be used as the storage space for waste toner, thus it is possible to efficiently use the space in which waste toner collecting container 200 occupies in the apparatus and easily detect the quantity of the toner in waste toner collecting container 200.

Here, in the embodiment and variational examples described above, elastic support 240 is arranged between one surface 110*a* of the main apparatus body 110 side and waste toner receptacle 220 so as to support the bottom of waste toner receptacle 220. However, the technology should not be limited to this configuration. For example, the elastic support may be integrally formed with the bottom of waste toner receptacle 220. Since it becomes possible with this configuration to attach or detach the elastic support at the same time when waste toner collecting container 200 is mounted or dismounted, the mounting and dismounting operation of waste toner collecting container 200 can be simplified.

Additionally, in the above embodiment and variational examples, joint 230 is formed of extensible and contractible resin and waste toner receptacle 220 moving downwards due to the extension of this joint 230 is supported by elastic support 240. However, the technology should not be limited to this configuration. For example an elastic member may be used for joint 230. This makes it possible to simply support waste toner receptacle 220 without use of any separate elastic support 240. That is, it is possible to reduce the number of parts as well as to simplify the apparatus configuration.

Having described the preferred embodiments of the technology, it goes without saying that the technology should not be limited to the above-described examples, and it is obvious that various changes and modifications will occur to those skilled in the art within the scope of the appended claims. Such variations are therefore understood to be within the technical scope of the technology.

For example, in the above embodiment, the technology is applied to a color image forming apparatus, however the technology can also be applied to a monochrome image forming apparatus including a waste toner collecting container to collect waste toner.

What is claimed is:

1. An image forming apparatus comprising:

a cleaning portion for collecting waste toner, which is the toner that was supplied to form a toner image on a toner image bearer but has not transferred to the recording medium and remains on the toner image bearer after the transfer stage;

a waste toner discharger for discharging the waste toner collected by the cleaning portion;

a waste toner collecting container; and a detector, characterized in that the waste toner collecting container includes:

a waste toner receptacle for storing the waste toner discharged from the waste toner discharger, wherein a supporting portion for supporting the waste toner receptacle by elastic force is integrally formed with the bottom of the waste toner receptacle;

a waste toner collector for leading the waste toner collected by the cleaning portion into the waste toner receptacle; and a joint for coupling the waste toner collector and the waste toner receptacle, the waste toner collecting container is removably mounted to the image forming apparatus;

the joint has the function of extending and contracting itself to enable the waste toner receptacle to shift relative to the waste toner collector; and the detector, when the waste toner receptacle has moved due the weight of the collected waste toner in the waste toner receptacle, detects the waste toner receptacle that has moved.

2. The image forming apparatus according to claim 1, wherein a vibrator for vibrating the waste toner receptacle is provided adjacently to the waste toner receptacle.

3. The image forming apparatus according to claim 1, wherein the joint is formed of an elastic member.

4. The image forming apparatus according to claim 1, wherein the waste toner collector includes a fitting portion that engages the waste toner discharger.

5. The image forming apparatus according to claim 1, wherein the waste toner collecting container includes a plurality of waste toner collectors arranged side by side for leading the waste toner collected from a plurality of cleaning portions.

6. The image forming apparatus according to claim 2, wherein the detector is prohibited from detecting the waste toner receptacle while the vibrator is vibrating the waste toner receptacle.

7. The image forming apparatus according to claim 1, wherein the detector detects a full state of the waste toner collecting container.

8. The image forming apparatus according to claim 1, wherein the detector detects a quantity of waste toner collected in the waste toner collecting container at multiple levels.

9. The image forming apparatus according to claim 1, wherein the detector is formed of a contact type switch.

10. The image forming apparatus according to claim wherein the detector is formed of a reflection type optical sensor.

11. The image forming apparatus according to claim 1, wherein the detector is formed of a shading type optical sensor.

12. The image forming apparatus according to claim 1, wherein the waste toner receptacle is substantially rigid, and where the joint for coupling the waste toner collector and the waste toner receptacle is a flexible joint.

13. An image forming apparatus comprising:

a cleaning portion for collecting waste toner, which is the toner that was supplied to form a toner image on a toner image bearer but has not transferred to the recording medium and remains on the toner image bearer after the transfer stage;

a waste toner discharger for discharging the waste toner collected by the cleaning portion;

a waste toner collecting container; and a detector, characterized in that the waste toner collecting container includes:

a waste toner receptacle for storing the waste toner discharged from the waste toner discharger;

a waste toner collector for leading the waste toner collected by the cleaning portion into the waste toner receptacle; and a joint for coupling the waste toner collector and the waste toner receptacle, a vibrator for vibrating the waste toner receptacle is provided adjacently to the waste toner receptacle, the waste toner collecting container is removably mounted to the image forming apparatus;

the joint has the function of extending and contracting itself to enable the waste toner receptacle to shift relative to the waste toner collector; and the detector, when the waste toner receptacle has moved due the weight of the collected waste toner in the waste toner receptacle, detects the movement of the waste toner receptacle, and wherein the detector is prohibited from conducting a detecting operation while the vibrator is vibrating the waste toner receptacle.

* * * * *